United States Patent [19]

Shirai et al.

[11] Patent Number: 4,610,946

[45] Date of Patent: Sep. 9, 1986

[54] ALUMINUM-ZIRCONIUM ALLOY SUPPORT FOR LITHOGRAPHIC PRINTING PLATE

[75] Inventors: Akira Shirai; Kazushige Takizawa; Yasuhisa Nishikawa; Tadayuki Katoh, all of Shizuoka, Japan

[73] Assignees: Fuji Photo Film Co., Ltd.; Nippon Light Metal Co., Ltd., both of Japan

[21] Appl. No.: 582,501

[22] Filed: Feb. 22, 1984

[30] Foreign Application Priority Data

Feb. 22, 1983 [JP] Japan ..... 58-26938

[51] Int. Cl.[4] ..... G03C 1/76

[52] U.S. Cl. ..... 430/278; 204/58; 430/526

[58] Field of Search ..... 430/278, 526; 204/58

[56] References Cited

U.S. PATENT DOCUMENTS

| | | | |
|---|---|---|---|
| 4,116,695 | 9/1978 | Mori et al. | 430/278 |
| 4,292,388 | 9/1981 | Ikeda et al. | 430/278 |
| 4,301,229 | 11/1981 | Sakaki et al. | 430/278 |
| 4,419,438 | 12/1983 | Etoh et al. | 430/278 |
| 4,427,500 | 1/1984 | Platzer | 430/278 |
| 4,435,230 | 3/1984 | Fujikura | 430/278 |

*Primary Examiner*—Jack P. Brammer

*Attorney, Agent, or Firm*—Sughrue, Mion, Zinn, Macpeak and Seas

[57] ABSTRACT

A support for lithographic printing plates is disclosed which comprises a plate of an aluminum alloy containing 0.02 to 0.20% by weight zirconium. The aluminum alloy causes no recrystallization phenomenon at temperatures below 320° C. There is also disclosed a photosensitive lithographic printing plate comprising such a support with a photosensitive layer thereon.

6 Claims, No Drawings

ALUMINUM-ZIRCONIUM ALLOY SUPPORT FOR LITHOGRAPHIC PRINTING PLATE

FIELD OF THE INVENTION

This invention relates to a support for lithographic printing plates, and more particularly to an improved aluminum alloy support for lithographic printing plates.

BACKGROUND OF THE INVENTION

A lithographic printing plate widely used at present is generally prepared by applying printing plate-making treatments such as image exposure, development, washing, lacquering, etc., to a so-called "presensitized printing plate (PS plate)" prepared by coating a photo-sensitive composition on an aluminum plate the surface of which is subjected to a graining treatment. By image exposure, a difference in solubility for a developer in the subsequent development is formed between the exposed areas and the unexposed areas of the layer of the foregoing photo-sensitive composition and then either the exposed areas or unexposed areas of the photosensitive composition layer are dissolved off or peeled off by the subsequent development process while leaving other areas of the layer on the aluminum plate to form an image. The image areas, i.e., the areas composed of the remaining photosensitive composition layer are ink receptive while in the non-image areas the hydrophilic aluminum support surface is exposed by the removal of the photosensitive composition layer as described above and hence the non-image areas are water receptive.

Accordingly, a dampening or fountain solution (water or an aqueous solution) is supplied to the surface of the plate having both the foregoing areas, whereby the film of the dampening solution is retained at the non-image areas, an ink is applied to the image areas, and by repeating the step of transferring the ink applied to the image areas directly or indirectly (i.e., after temporarily transferring the ink onto a blanket) onto the surface of a paper, printing is performed.

In such a printing system, by suitably selecting a photosensitive composition coated on a support, it is possible to obtain a printing plate capable of providing more than 100,000 good copies from one printing plate. However, in the present situation of printing industries, a printing plate capable of printing further increased copies is demanded and further by the reasons of the reduction of the cost for printing plate and simplification of printing operation, it has been keenly desired to obtain more copies by the same printing plate, i.e., to improve the press life of a printing plate.

With a lithographic printing plate using aluminum as the support, a so-called burning-in process is employed as a means of improving the press life. That is, a method of heating, to a high temperature, a lithographic printing plate prepared by image exposing and developing a photosensitive printing plate by ordinary manners, whereby the composition forming the image areas is hardened by heat to strengthen the image areas is effective and has generally been employed. In this case the heating temperature and the heating time for the burning-in process usually depend upon the composition forming the image but are generally about 200° to 280° C. and about 3 to 7 minutes, respectively. However, even in the burning-in process, it has been desired to perform the process at a higher temperature and for a shorter operation time for further improving the press life of the printing plate and for further shortening the operation time.

On the other hand, an aluminum plate used as a support for lithographic printing plates is prepared by subjecting an aluminum alloy such as AA1050, AA1100, AA3003, etc., to an ordinary continuous casting to form an ingot of the aluminum alloy, applying hot rolling, cold rolling, and, if necessary, heat treatment in processing the ingot of the aluminum alloy to form a plate or a web of the aluminum alloy, graining the surface thereof a mechanical method, a chemical method, an electrochemical method or by a composition of these methods, and further, if desired, anodically oxidizing the grained plate or web.

However, an aluminum alloy plate composed of the aluminum alloy as described above conventionally used for the aforesaid purpose causes a recrystallization phenomenon of aluminum when the aluminum alloy plate is heated to a temperature of higher than 280° C., thereby greatly reducing the strength of the plate and losing firmness of the plate. Therefore, when such an aluminum plate is used as a support for lithographic printing plates, there are problems in that handling of the printing plate is very difficult. For example, it becomes impossible to mount the printing plate on a printing cylinder of a press, and it is impossible to make resistering the printing plate in the case of multicolor printing.

SUMMARY OF THE INVENTION

A primary object of this invention is to provide an aluminum alloy plate which is resistant to heat softening and hardly reduces the excellent printing properties of a conventional aluminum support for lithographic printing plates.

That is, according to this invention, there is provided a support for lithographic printing plates comprising a plate of an aluminum alloy containing 0.02 to 0.20% by weight zirconium, said aluminum alloy causing no recrystallization phenomenon at temperatures lower than 320° C. It is more desirable that the surface of the support of this invention is grained and anodically oxidized.

DESCRIPTION OF THE PREFERRED EMBODIMENT

In the aluminum alloy used in this invention, it is preferred that the aluminum base metal used has a purity of 99.50% by weight or higher.

Impurities which may be contained in the base metal include small amounts of iron, silicon, etc., and further a slight amount of other impurities such as manganese, copper, titanium, etc. Iron is preferably contained in an amount of 0.40% by weight or less and silicon preferably in an amount of 0.20% by weight or less, based on the weight of the alloy. (Throughout the specification, content in the alloy is represented based on the weight of the alloy). Manganese, copper, titanium or other impurities are preferably contained in an amount of 0.05% by weight or less. The characteristic component in the aluminum alloy of this invention is zirconium and the content thereof is preferably 0.02 to 0.20% by weight, more preferably 0.03 to 0.18% by weight. If the content of zirconium is less than 0.02% by weight, the effect of improving the heat softening property of the aluminum alloy plate is insufficient, while if the content of zirconijm is more than 0.20% by weight, the heat softening property is further improved but the crystal texture of the aluminum plate becomes non-uniform which reduces the printability of the printing plate.

Also, iron has an effect of preventing the crystals of aluminum from becoming finer and the recrystallizing crystals from growing larger but if the content of iron in the aluminum alloy of this invention is more than 0.40% by weight, the size of iron compounds formed at casting becomes large, which results in reducing the printability of the printing plate. Furthermore, if the content of silicon in the aluminum alloy of this invention is more than 0.20% by weight, the effect of improving the heat softening property of the aluminum plate by the incorporation of zirconium is reduced and hence it is preferred that the content of silicon be 0.20% by weight or less.

An aluminum alloy plate used in this invention may be prepared according to the known processes for obtaining aluminum alloy plate. The processes are described, for example, in Japanese Patent Publication No. 39325/73, Japanese Patent Application (OPI) No. 25207/79 (the term "OPI" as used herein refers to a "published unexamined Japanese patent application") and Yanagisawa et al. "Light Metals" 6.68–75 (1956).

A representative process for obtaining the aluminium alloy plate is as follows.

An aluminum alloy plate as a support for lithographic printing plates of this invention is prepared from the foregoing aluminum alloy by, for example, the following manner. That is, after grinding the surface of the DC (direct casting) ingot of the aluminum alloy as when using a conventional aluminum alloy, e.g., AA1050, AA1100, etc., the aluminum alloy ingot is treated in a soaking pit at ordinary temperature and subjected to hot rolling and then cold rolling to form a plate of the aluminum alloy having a proper thickness. The plate thus cold rolled is subjected to process annealing and, according to the working extent in the previous step, is further subjected to cold rolling for adjusting the properties to desired ones to provide the aluminum alloy plate.

The aluminum alloy plate thus prepared is roughened or grained by an electrochemical graining method of graining the plate. Their method may be carried out in an electrolyte such as an aqueous hydrochloric acid solution or an aqueous nitric acid solution while passing an electric current through the solution. The graining may also be carried out by a wire brush graining method of scratching the surface of the aluminum alloy plate with a metal wire, a ball graining method of graining the surface of the aluminum alloy plate by abrasive balls and abrasives, and a brush graining method of graining the surface of the aluminum alloy plate by a nylon brush and abrasives. The aforesaid graining methods may be used solely or in combination.

The aluminum alloy plate thus grained is then chemically etched by an acid or an alkali. When an acid is used as the etchant, it takes a very long period of time to collapse the fine structure and hence the application of etching with an acid solution is disadvantageous but the disadvantage can be decreased by using an alkali as the etchant.

Examples of the alkaline etchant preferably used for making the aluminum alloy support of theis invention are sodium hydroxide, sodium carbonate, sodium aluminate, sodium metasilicate, sodium phosphate, potassium hydroxide, lithium hydroxide, etc. The concentration of the alkali in the etchant is 1 to 50 g/m$^2$ and the temperature of the etchant is 20 to 100° C. These conditions are so selected so that the dissolved amount of aluminum becomes 5 to 20 g/m$^2$.

After alkali etching, the aluminum alloy plate is pickled in order to remove smut remaining on the surface thereof. For pickling, an acid such as nitric acid, sulfuric acid, phosphoric acid, chromic acid, hydrofluoric acid, borofluoric acid, etc., is used.

Also, for the removal of smut after the electro-chemical graining treatment, it is preferred to use the method of treating the surface with a sulfuric solution of 15 to 65% by weight sulfuric acid at a temperature of 50° to 90° C. as described in Japanese Patent Application (OPI) No. 12,739/78 (the term "OPI" indicates an unexamined published patent application open to public inspection) or the method of performing alkali etching as described in Japanese Patent Publication No. 28,123/73.

The aluminum alloy plate thus treated as described above may be used as a support for lithographic printing plates and may be further subjected to an anodical oxidation treatment, a chemical treatment, etc.

The anodical oxidation treatment can be performed by a method conventionally employed in this field. That is, by passing a direct current or alternating current through the aluminum plate in an aqueous solution of a non-aqueous solution of sulfuric acid, phosphoric acid, chromic acid, oxalic acid, sulfamic acid, benzenesulfonic acid, etc., solely or as a mixture of them, an anodically oxidized film or layer can be formed on the surface of the aluminum plate.

The treatment conditions for the anodic oxidation depend upon the kind of the electrolyte used, but in general, it is proper that the concentration of the electrolyte is 1 to 80% by weight, the temperature of the solution is 5° to 70° C., the current density is 0.5 to 60 amperes/dm$^2$, the voltage is 1 to 100 volts, and the electrolytic time is 10 to 100 sec.

Among these anodic oxidation treatments, the method of performing the anodic oxidation in an aqueous sulfuric acid solution at a high current density used in the invention described in U.K. Pat. No. 1,412,768 and the method of performing the anodic oxidation using an aqueous phosphoric acid solution as the electriolytic bath described in U.S. Pat. No. 3,511,661 are particularly preferred.

The anodically oxidized aluminum alloy plate can be further treated by a method of immersing in an aqueous solution of an alkali metal silicate such as sodium silicate as described in U.S. Pat. Nos. 2,714,066 and 3,181,461 or a subbing layer of a hydrophilic cellulose (e.g., carboxymethyl cellulose, etc.,) containing a water-soluble metal salt (e.g., zinc acetate, etc.,) may be formed on the surface of the anodically oxidized aluminum alloy plate as described in U.S. Pat. No. 3,860,426.

A photosensitive lithographic printing plate can be prepared by forming a photosensitive layer on the support for the lithographic printing plate of this invention and a printing plate obtained by subjecting the photosensitive lithographic printing plate to printing plate-making treatments has excellent properties.

Examples of the composition for the foregoing photosensitive layer are as follows:

(1) Photosensitive compositions composed of a diazo resin and a binder:

Preferred diazo resins are described in U.S. Pat. Nos. 2,063,631 and 2,667,415; Japanese Patent Publication Nos. 48,001/74; 45,322/74; and 45,323/74; U.K. Pat. No. 1,312,925, etc., and preferred binders are described in U.K. Pat. Nos. 1,350,521 and 1,460,978; and U.S. Pat. Nos. 4,123,276; 3,751,257; 3,660,097, etc.

(2) Photosensitive compositions composed of an o-quinonediazide compound:

Particularly preferred o-quinonediazide compounds are o-naphthoquinonediazide compounds as described in, for example, U.S. Pat. Nos. 2,766,118; 2,767,092; 2,772,972; 2,859,112; 2,907,665; 3,046,110; 3,046,111; 3,046,115; 3,046,118; 3,046,119; 3,046,120; 3,046,121; 3,046,122; 3,046,123; 3,061,430; 3,102,809; 3,106,465; 3,635,709; and 3,647,443.

(3) Photosensitive compositions composed of an acid compound and a binder (high molecular compound):

Examples include compositions composed of azide compounds and a water-soluble or alkali-soluble high molecular compound described in U.K. Pat. Nos. 1,235,281 and 1,495,861 and Japanese patent application (OPI) Nos. 32,331/76; 36,128/76, etc., and compositions composed of a polymer having an azide group and a high molecular compound as a binder described in Japanese Patent Application (OPI) Nos. 5102/75; 84,302/75; 84,303/75 and 12,984/78.

(4) Other photosensitive compositions:

Examples of other photosensitive compositions used for photosensitive lithographic printing plates include compositions containing the polyester compounds described in Japanese Patent Application (OPI) No. 96,696/77; compositions containing the polyvinyl cinnamate resins described in U.K. Pat. Nos. 1,112,277; 1,313,390; 1,341,004; 1,377,747, etc.; and compositions containing the photopolymerizable type photopolymers described in U.S. Pat. Nos. 4,072,528 and 4,072,527.

These photosensitive compositions may contain proper additives. For example, there are cyclic acid anhydrides as sensitizers for increasing the sensitivity of the photosensitive compositions, dyes as printing out agents for forming visible images immediately after image exposure, fillers for image areas, and coloring agents for coloring the photosensitive layer of the photosensitive printing plate.

A coating liquid for the photosensitive composition layer is prepared by adding a mixture of the foregoing proper components to an organic solvent. The concentration of the coating liquid is 2 to 50% by weight as solid components. The coating liquid is coated on the aluminum alloy support described above by a desired coating means, such as, a roll coating method, a reverse roll coating method, a gravure coating method, an air knife coating method, etc. The coating amount of the composition is about 0.1 to 7.0 g/m$^2$ as solid components, preferably about 0.5 to 4.0 g/m$^2$. After coating, the coated layer is dried in an ordinary manner. The photosensitive lithographic printing plate is, if necessary, cut into a proper size.

The photosensitive printing plate (original plate) thus prepared is imagewise exposed and developed in contact with a developer, in more detail, by dipping the plate in a developer or by supplying a developer onto the plate by spraying, etc. The developer used for developing the photo-sensitive printing plate is specific to each photosensitive composition described above and since practical developers are shown in the patent specifications described hereinbefore in regard to the photosensitive compositions the developer corresponding to each composition may be employed.

With positive-working composition the exposed portions are removed at development and with negative-working composition the non-image portions are removed at development. Thus, according to the purposes, a positive-working composition or a negative-working composition may be properly selected.

After development, the printing plate is, if desired, subjected to proper post treatment.

A post treatment which has the most intimate relation with this invention is a burning-in process for strengthening the image portions of the photosensitive composition layer. A burning-in process is described in, for example, Japanese Patent Application (OPI) No. 6205/77 (corresponding to Canadian Pat. No. 1,084,758) and No. 34,001/76 (corresponding to U.S. Pat. No. 4,294,910); Japanese Patent Publication Nos. 28,062/80 (corresponding to U.S. Pat. No. 4,063,507) and 3938/82; U.S. Pat. No. 4,191,570, etc. Fundamentally, in a burning-in process, the developed printing plate is placed in an atmosphere of 150° C. to 350° C. to harden the image portions of the photosensitive composition layer of the plate by burning. In this case it is preferred to supply an aqueous solution of boric acid, a borate, an anionic surface active agent, or a compound having other specific chemical structure onto the surface of the plate. By the treatment, various troubles caused by the burning-in process can be prevented. The burning temperature is related to the burning treatment time and the burning effect desired and the burning-in process can be performed at a temperature of 180° C. to 300° C. when the treatment time is about 3 to 10 minutes.

The aluminum alloy support of this invention can sufficiently endure such a severe burning-in process. That is, when the printing plate having the aluminum alloy support of this invention is subjected to the burning-in process, the support can stably maintain the original properties and the printing plate shows very high printing power.

The invention will now be explained in more detail by the following examples, in which all percentages are by weight unless otherwise indicated. However, this invention is not limited to these specific examples.

EXAMPLE 1

Each of three kinds of aluminum DC ingots shown in Table 1 was subjected to a homogenizing treatment at 560° C. for 6 hours and then subjected to hot rolling and the cold rolling to form a plate of 1.5 mm in thickness. The plate was then subjected to process annealing for one hour at 400° C. and then subjected to final cold rolling to form a plate 0.3 mm thick. The chemical compositions of the three kinds of aluminum alloys used in the experiments are shown in Table 1.

TABLE 1

| Alloy | Chemical composition (wt %) | | | | | | |
|---|---|---|---|---|---|---|---|
| | Fe | Si | Mn | Cu | Ti | Zr | Residue |
| A* | 0.32 | 0.08 | <0.01 | <0.01 | 0.02 | 0.05 | Al |
| B* | 0.32 | 0.08 | <0.01 | <0.01 | 0.03 | 0.16 | Al |
| C** | 0.30 | 0.10 | <0.01 | <0.01 | 0.03 | — | Al |

*The aluminum alloy of this invention
**Comparison material

Each of the rolled plates of these aluminum alloys was grained in a suspension of pumice in water using a rotary nylon brush and etched using an aqueous solution of 20% sodium hydroxide so that the dissolved amount of aluminum became 5 g/m$^2$. After sufficiently washing the plate with running water, the plate was pickled with an aqueous 25% nitric acid solution and washed with water to provide each base plate. The base plate thus prepared was electrolyzed by alternating current in an electrolyte containing 0.5 to 2.5% nitric acid at a current density above 20 A/dm$^2$ as described in Japanese Patent Application (OPI) No. 146,234/79. Thereafter, the plate was immersed in an aqueous solution of 15% sulfuric acid at 50° C. for 3 minutes to clean the surface of the plate and then anodically oxidized in an electrolyte containing 20% sulfuric acid as the main component at 30° C. to form an oxide layer of 3 g/ m$^2$.

On each of the samples thus prepared was formed a photosensitive layer having the following composition with a dry coating amount of 2.5 g/m$^2$.

| | |
|---|---|
| Ester compound of naphthoquinone-1.2-diazido-5-sulfonyl chloride with pyrogallol-acetone resin (described in the example of U.S. Pat. No. 3,635,709) | 0.75 g |
| Cresol novolak resin | 2.00 g |
| Oil Blue #603 (made by Orient Kagaku K.K.) | 0.04 g |
| Ethylene dichloride | 16 g |
| 2-Methoxyethyl acetate | 12 g |

After exposing each of the photosensitive lithographic printing plates thus prepared in a contact relation of a transparent positive to a PS light (trade name, sold by Fuji Photo Film Co., Ltd., having a metal halide lamp, MU2000-2-OL type of 3 KW, made by Toshiba Corporation, as a light source) for 30 seconds from a distance of 1 meter, the printing plate was developed in an aqueous solution of 5% by weight sodium silicate for about one minute. Then, after washing the plate with water, the developed plate was treated with a sponge impregnated with an aqueous solution of 4% by weight potassium borate for preventing the occurrence of stains at the background portion in a burning-in process followed by squeezing to coat the solution as uniformly as possible.

The printing plate thus treated was dried and heated by means of a burning processor 1300 [having a heat source of 12 KW, sold by Fuji Photo Film Co., Ltd.] to temperatures of 260° C., 280° C., 300° C. or 320° C. for 7 minutes. After cooling, the 0.2% yield strength of each of the printing plates burn treated at 260° C. to 320° C. was measured by a tensile test. The results are shown in Table 2.

TABLE 2

| | 0.2% Yield strength (kg/mm$^2$) | | | | |
|---|---|---|---|---|---|
| Aluminum alloy | Normal temp. | 260° C. | 280° C. (7 minutes) | 300° C. | 320° C. |
| A* | 14.7 | 13.4 | 12.9 | 10.7 | 2.6 |
| B* | 15.0 | 13.6 | 12.2 | 8.2 | 8.0 |
| C** | 14.0 | 10.7 | 3.7 | 2.6 | 2.5 |

*Material of this invention
**Comparison material

Normal temperature means that the sample was not subjected to burning-in process.

As shown in the table, the materials A and B of this invention has high yield strength at high temperatures and strong finness as compared to comparison material C and the printing plates using the aluminum alloy plates of this invention can be readily handled.

Also, when each of the printing plates was mounted on an offset printing machine and printing was performed, good prints without stains at non-image areas and without spot-like stains were obtained when using the aluminum alloy plates of this invention as the supports. The press life of each printing plate during printing is shown in Table 3.

TABLE 3

| | Press life (× 10$^4$ prints) | | | | |
|---|---|---|---|---|---|
| Aluminum alloy | Normal temp. | 260° C. | 280° C. (7 minutes) | 300° C. | 320° C. |
| A* | 12 | 18 | 20 | 23 | — |
| B* | 12 | 18 | 20 | 23 | 25 |
| C** | 12 | 18 | — | — | — |

*Material of this invention
**Comparison material

EXAMPLE 2

Each of the aluminum alloys as used in Example 1 was subjected to the surface treatment as in Example 1 and a printing plate was prepared by the same procedure as in Example 1. Each of the printing plates was heated by means of a burning processor 1300 at a temperature of 260° C., 280° C., 300° C., or 320° C. for one minute.

After cooling, the 0.2% yield strength of each of the printing plates thus subjected to the burning-in process at 260° C. to 320° C. was measured by a tension test. The results are shown in Table 4.

TABLE 4

| | 0.2% Yield strength (kg/mm$^2$) | | | | |
|---|---|---|---|---|---|
| Aluminum alloy | Normal temp. | 260° C. | 280° C. (1 minute) | 300° C. | 320° C. |
| A* | 14.7 | 13.5 | 13.0 | 12.4 | 10.8 |
| B* | 15.0 | 13.8 | 13.2 | 12.6 | 12.1 |
| C** | 14.0 | 12.1 | 9.7 | 5.9 | 2.5 |

*Material of this invention
**Comparison material

As shown above, the materials A and B of this invention have very high yield strength and strength buckling resistance at high-temperature treatment for a short period of time as compared to comparison sample C and the printing plates using the aluminum alloy plates A and B of this invention can be readily handled.

While the invention has been described in detail and with reference to specific embodiments thereof, it will be apparent to one skilled in the art that various changes and modifications can be made therein without departing from the spirit and scope thereof.

What is claimed is:

1. A photosensitive lithographic printing plate comprising a support of an aluminum alloy plate and a photosensitive layer thereon, the aluminum alloy plate comprising an aluminum alloy containing 0.02 to 0.20% by weight zirconium and causing no recrystallization phenomenon at temperatures below 320° C.

2. A photosensitive lithographic printing plate as claimed in claim 1, wherein the aluminum alloy has a purity of 99.50% by weight or higher.

3. A photosensitive lithographic printing plaste as claimed in claim 1, wherein the aluminum alloy contains 0.40% by weight iron or less, and 0.20% by weight silicon or less.

4. A photosensitive lithographic printing plate as claimed in claim 1, wherein the surface of the plate of the aluminum alloy is grained.

5. A photosensitive lithographic printing plate as claimed in claim 4, wherein the surface of the plate of the alluminum is further anodically oxidized.

6. A photosensitive lithographic printing plate as claimed in claim 1, wherein the aluminum alloy contains 0.03 to 0.18 percent by weight zirconium.

* * * * *